US005969241A

United States Patent [19]

Auzerais

[11] Patent Number: 5,969,241

[45] **Date of Patent: *Oct. 19, 1999**

[54] METHOD AND APPARATUS FOR MEASURING FORMATION PRESSURE

[75] Inventor: François M. Auzerais, Ridgefield, Conn.

[73] Assignee: Schlumberger Technology Corporation, Ridgefield, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/632,370

[22] Filed: Apr. 10, 1996

[51] Int. Cl.[6] ..... E21B 47/00

[52] U.S. Cl. ..... 73/152.16; 73/152.47

[58] Field of Search ..... 73/152.02, 152.07, 73/152.09, 152.11, 152.16, 152.22, 152.27, 152.32, 152.51, 152.47

[56] References Cited

U.S. PATENT DOCUMENTS

| | | | |
|---|---|---|---|
| Re. 33,063 | 9/1989 | Obeda | 156/73.1 |
| 2,972,380 | 2/1961 | Bodine, Jr. | 166/46 |
| 3,564,914 | 2/1971 | Desai et al. | 73/152.16 |
| 3,865,201 | 2/1975 | Haden | 73/152.16 |
| 4,236,580 | 12/1980 | Bodine | 166/301 |
| 4,852,069 | 7/1989 | Clerke et al. | 73/152.16 |
| 4,860,581 | 8/1989 | Zimmerman et al. | 73/155 |
| 5,463,549 | 10/1995 | Dussan et al. | 364/422 |
| 5,515,922 | 5/1996 | Ruttley | 166/301 |

FOREIGN PATENT DOCUMENTS

| | | | |
|---|---|---|---|
| 0 697 501 A2 | 2/1996 | European Pat. Off. | E21B 49/00 |
| 0 699 819 A2 | 3/1996 | European Pat. Off. | E21B 33/127 |

OTHER PUBLICATIONS

Widener, M. Ward, "The Development of High–Efficiency Narrow–Band Transducers and Arrays," *Journal of Acoustical Society of America,* vol. 67, No., 3 (Mar. 1980), pp. 1052–1057.

"The Development of a Deep Submergence, Air–backed Transder," *Journal Acoustical Society of America:* Technical Notes and Research Briefs, vol. 80, No. 6 (Dec. 86), pp. 1852–1853.

Venkitaraman, Adinathan, et al. "Ultrasonic Removal of Near–Wellbore Damage Caused by Fines and Mud Solids," *SPE Drilling & Completion,* Sep. 1995, pp. 193–195.

*Primary Examiner*—Max Noori

*Attorney, Agent, or Firm*—Brigitte L. Jeffrey; Keith G.W. Smith; David P. Gordon

[57] ABSTRACT

An earth formation tool measures pressure from within a borehole. A portion of the borehole wall is isolated from surrounding borehole fluids by placing a chamber of a borehole tool against the borehole wall. The chamber comprises a recess in an exterior surface of a borehole tool. Mudcake present on the isolated portion of the borehole wall is disintegrated by an ultrasonic transducer within the chamber. In this manner, there is no resistance to fluid flow from the chamber to the formation. A pressure gauge measures pressure of the chamber to indicate pressure of the earth formation. This approach can be used to make moving or stationary measurements of earth formation pressure.

20 Claims, 6 Drawing Sheets

METHOD AND APPARATUS FOR MEASURING FORMATION PRESSURE

FIELD OF THE INVENTION

The invention relates to the evaluation of earth formations. More specifically, the invention relates to measuring pressure of an earth formation from within a borehole.

U.S. patent application Ser. No. 08/630,739 filed the same day as this application describes a METHOD AND APPARATUS FOR REMOVING MUDCAKE FROM BOREHOLE WALLS by Auzerais et al.

BACKGROUND OF THE INVENTION

Currently, pressure of an earth formation is measured from within a borehole by using a tool such as the RFT (Mark of Schlumberger; Repeat Formation Tester) or the MDT (Mark of Schlumberger; Modular Dynamic Tester), for example. A tool of the MDT type is generally described in U.S. Pat. No. 4,860,581 to Zimmerman et al. Briefly, the tool is lowered into a borehole and a packer of the tool is placed against a portion of the borehole wall to isolate that portion of the formation from borehole fluids. The packer surrounds a probe. As a "draw-down" pressure is applied at the probe, pressure at the isolated portion of the borehole wall decreases to a pressure substantially below that of the formation. This draw-down pressure effectively cleans the isolated portion of the borehole wall by drawing mudcake from the borehole wall via the probe. This facilitates fluid flow from the formation. The probe then is filled with formation fluid, during the applied draw-down. The pressure inside the probe is lower than the formation pressure as a result. A pressure gauge connected to the chamber then indicates pressure of the earth formation.

SUMMARY OF THE INVENTION

The invention concerns an apparatus and method for measuring earth formation pressure from within a borehole. In one embodiment, a volume is defined by isolating a portion of the borehole wall from surrounding borehole fluids with a borehole tool. The volume contains fluid and mudcake adjacent the borehole wall. The mudcake within the volume is fluidized. Pressure of the volume is detected and a signal is produced representing pressure of the formation, as pressure of the volume and formation reach equilibrium. An earth formation characteristic is indicated based on the produced signal.

In another embodiment, a portion of the borehole wall is isolated from surrounding borehole fluids by placing a chamber against the borehole wall. Mudcake present on the isolated portion of the borehole wall is moved into fluid suspension. Pressure of the chamber which is initially at higher pressure than the formation is measured to give an indication of the pressure of the earth formation.

Preferably, an ultrasonic transducer within or comprising the chamber disintegrates or fluidizes the mudcake so there is no resistance to fluid flow from the chamber to the formation. There is no need to apply a draw-down pressure as with other approaches, resulting in faster measurements of earth formation pressure. Thus, there is no need for pretests, sampling or pumps. This approach can be used to make moving or stationary measurements of earth formation pressure, as discussed below.

DETAILED DESCRIPTION OF THE INVENTION

Figure 1:
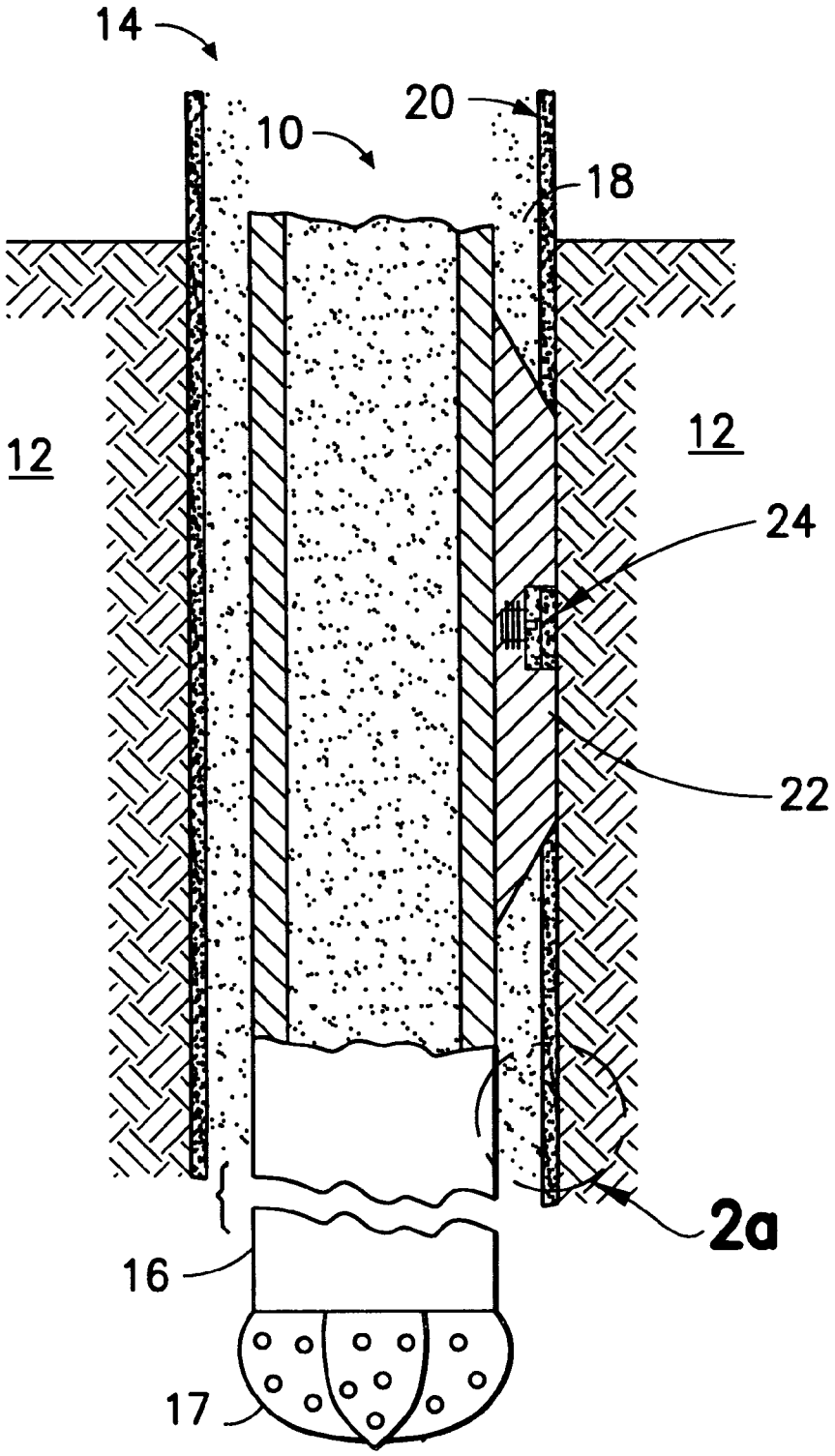
FIGS. 1 and 3 are schematic drawings of a tool for evaluating earth formations in a borehole.

FIGS. 1 and 2 are schematic drawings of a tool 10 for evaluating earth formations 12 in a borehole 14. A logging-(or measuring)-while-drilling version of the tool 10 enters the borehole 14 as part of a drill stem 16 behind a drill bit 17 which bores into the earth formation 12. Such logging-while-drilling tool logs data representing characteristics of the formation as a function of depth. The drill stem 16 or a drill collar, which holds the drill bit 17, comprise a housing of the tool 10. Drilling muds form a mud column 18 which is pumped to circulate through the borehole 14: down through the center of the drill stem 16 and up along the borehole wall to carry cuttings of the formation to the surface. As the mud column 18 circulates, mud accumulates on the walls of the borehole 14, forming a mudcake 20. A stabilizer 22 (one shown, typical of four arranged laterally around the tool, for example) centers the tool 10 within the borehole 14. Pressure sensors 24 (one shown, typical of any number and described below) are mounted on an outer surface of the stablizer 22 such that pressure sensors directly engage the borehole wall while the tool 10 is moving and drilling, or idle and stationary. The pressure sensors 24 are preferably mounted on a structure like the stabilizer 22 which projects radially beyond the diameter of the drill stem 16 or drill collar. In this manner, the pressure sensors 24 are more likely to engage the borehole wall. Alternatively, the pressure sensors 24 are mounted directly on the housing of the tool 10.

Figure 2A:
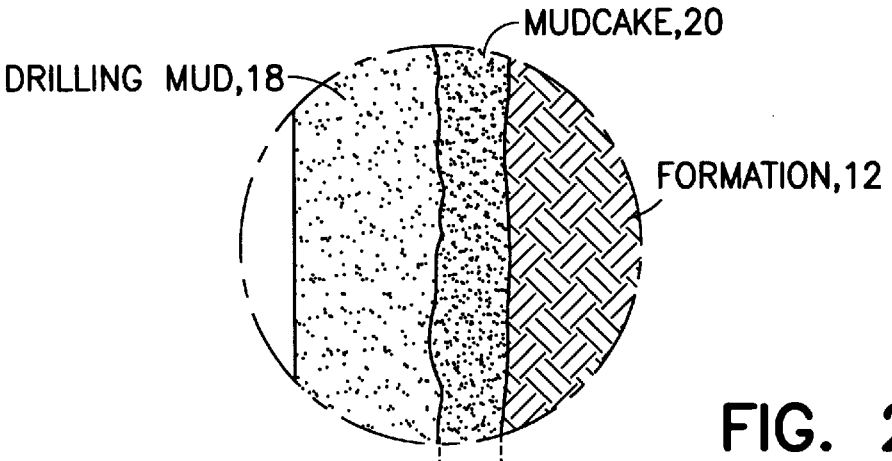
FIGS. 2*a–b* illustrate relative pressures of mud column fluids, earth formation, and pressure gradient in the mudcake.
Figure 2B:
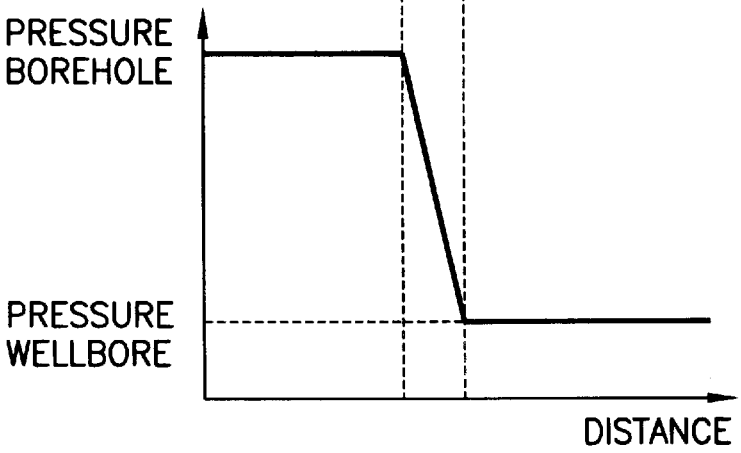

FIG. 2*a* is an enlarged portion of FIG. 1. Mudcake 20 forms a relatively impermeable membrane between the drilling mud 18 comprising a mud column and the formation 12. FIG. 2*b* illustrates relative pressures of the drilling mud 18, mudcake 20, and earth formation 12. Pressure is very generally illustrated as a function of distance from the center of the borehole. Pressure in the wellbore (borehole) is high, the drilling mud 18 being under great pressure as they are pumped through the borehole 14. A pressure drop occurs across the mudcake 20 which forms a relatively impermeable membrane between the formation 12 and drilling mud 18. Pressure at the formation 12 is lower than that of the drilling mud 20 in the borehole 14. This assumes uniform pressure in the formation as a function of distance from the borehole for simplicity, not excluding pressure change due to invasion or supercharging. U.S. Pat. No. 5,463,549 to Dussan V. et al.

Figure 3:
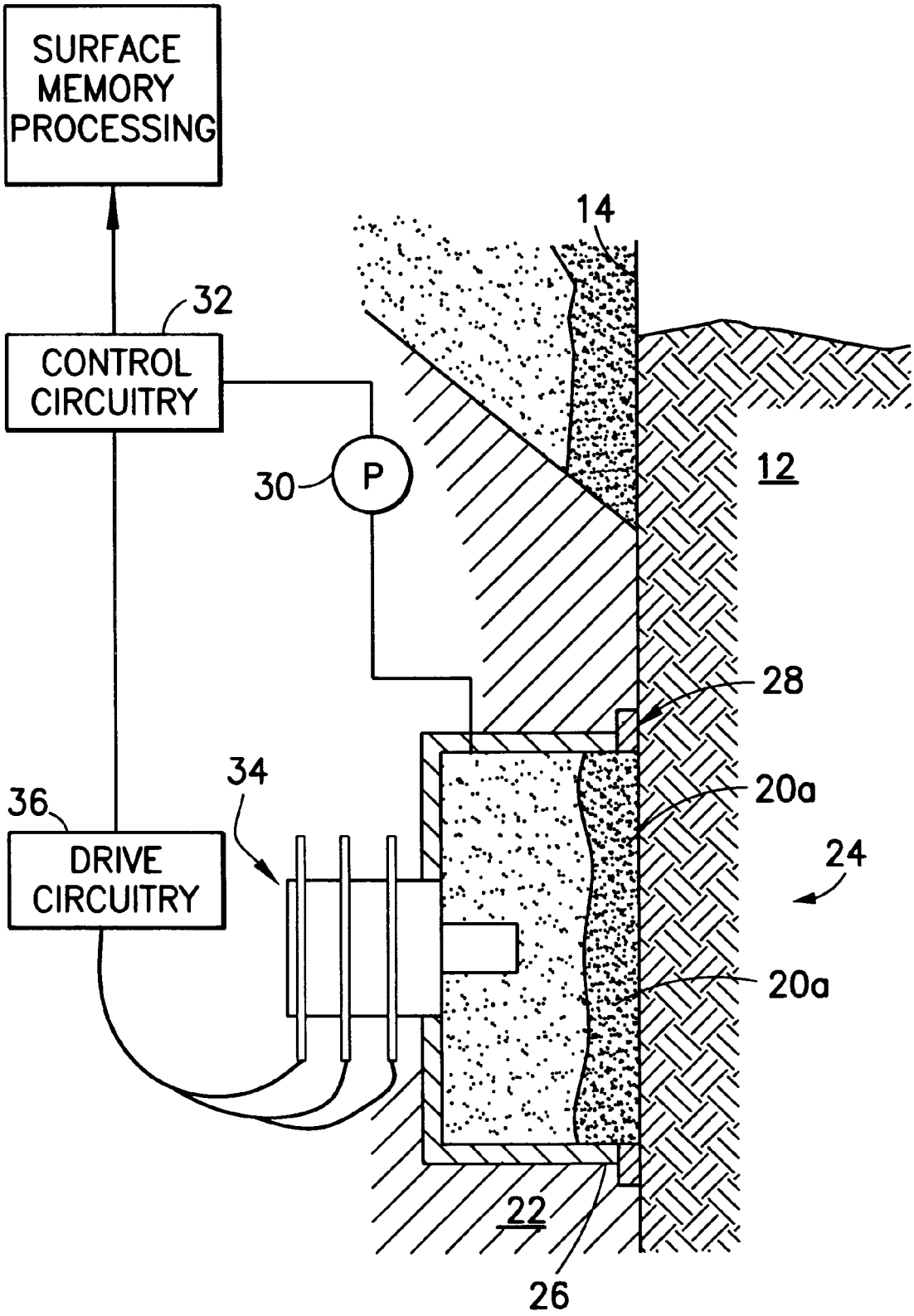

FIG. 3 is an enlarged view of a portion of FIG. 1. A pressure sensor 24 is mounted on a stabilizer 22 which engages the formation 12 at a wall of the borehole 14. The pressure sensor 24 includes a cup 26 inserted in an outer surface of the stabilizer 22. The cup 26 defines a chamber. For this embodiment, a grommet 28 seals the cup 26 in place. Alternatively, a recess cut into the outer surface of the stabilizer 22 can define the chamber. The cup 26, or recess, is open at one end to receive solids or fluids, like the drilling mud 18, mudcake 20, or other borehole or formation liquids or materials. A pressure gauge 30 connects to the chamber and control circuitry 32 to measure pressure within the chamber. An acoustic horn 34 protrudes into the chamber. Drive circuitry 36 connects to the acoustic horn 34 and includes a feedback controller and power supply, for example.

The pressure sensor 24 isolates a portion of the formation 12. Specifically, the pressure sensor 24 isolates a section of the borehole wall, enclosing drilling muds 18*a* and mudcake 20*a* within the chamber. As discussed concerning FIGS. 2*a* and 2*b*, the pressure in the chamber is initially that of the borehole 14, which is substantially above the pressure of the formation 12. As a result, the mudcake 20*a* forms a relatively impermeable membrane between the chamber and the formation 12, restricting fluid flow between the chamber and the formation 12. The drive circuitry 36 oscillates the acoustic horn 34 at a chosen frequency for a time period determined by the control circuitry 32. In this manner, the acoustic horn 34 emits an acoustic pulse through the drilling mud 18*a* toward the mudcake 20*a*. The acoustic pulse fluidizes the mudcake 20*a*. That is, the acoustic pulse is of sufficient intensity and frequency to vibrate or oscillate the mudcake 20*a* into fluid suspension within the drilling mud 18*a*. The mudcake 20*a* fluidizes in microseconds. In effect, the mudcake "membrane" disintegrates. Because the borehole pressure is substantially above that of the formation 12 and because the mudcake 20*a* has fluidized, fluid flow occurs between the chamber and the formation 12 until pressure equilibrium is reached. The pressure gauge 30 generates a signal indicating the pressure of the chamber at or near equilibrium to the control circuitry 32. This signal represents a direct measurement of the pressure in the formation. Alternatively, if the formation is supercharged due to forced invading fluids, it is then possible to measure the supercharged pressure, instead of the true formation pressure. The control circuitry 32 then transmits this formation pressure signal to a memory for storage, or to the surface to be recorded as a log or for processing to evaluate a characteristic of an earth formation. Preferably, the pressure measurement is made while the mudcake is being fluidized by the acoustic horn 34.

Figure 4A:
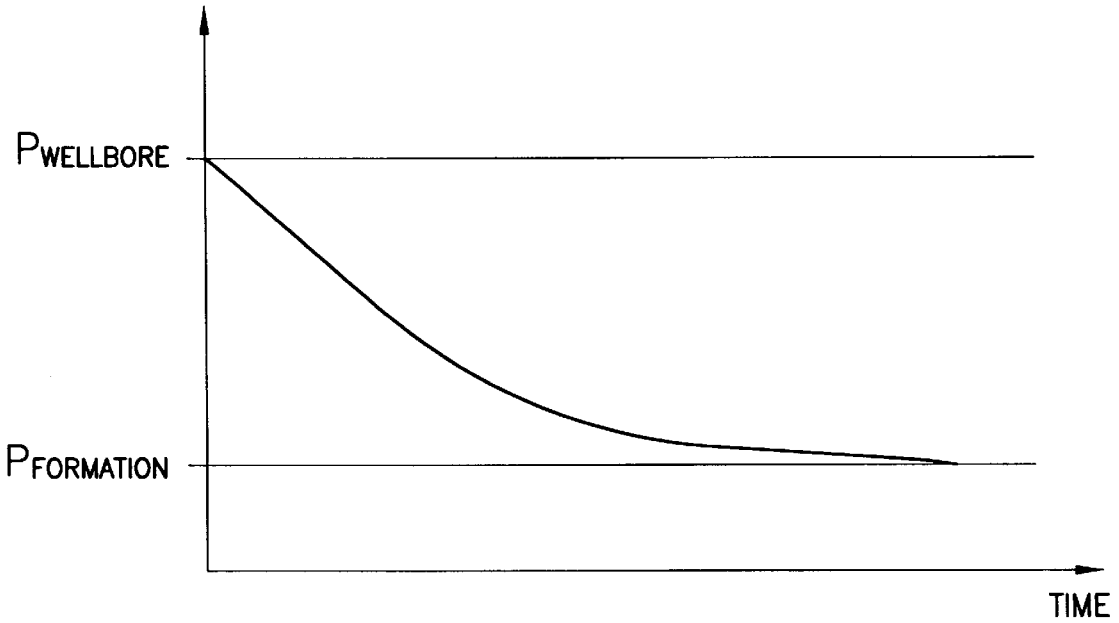
FIGS. 4*a–c* illustrate different pressure drops occurring in isolated portions of the formation when mudcake is undisturbed and when mudcake is fluidized.
Figure 4B:
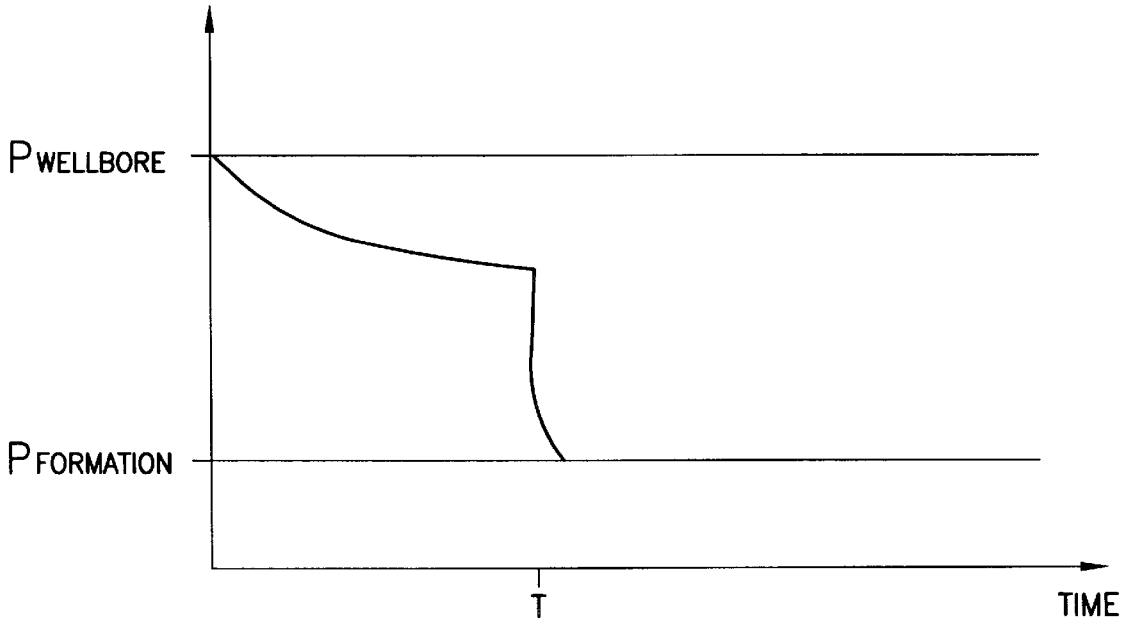
Figure 4C:
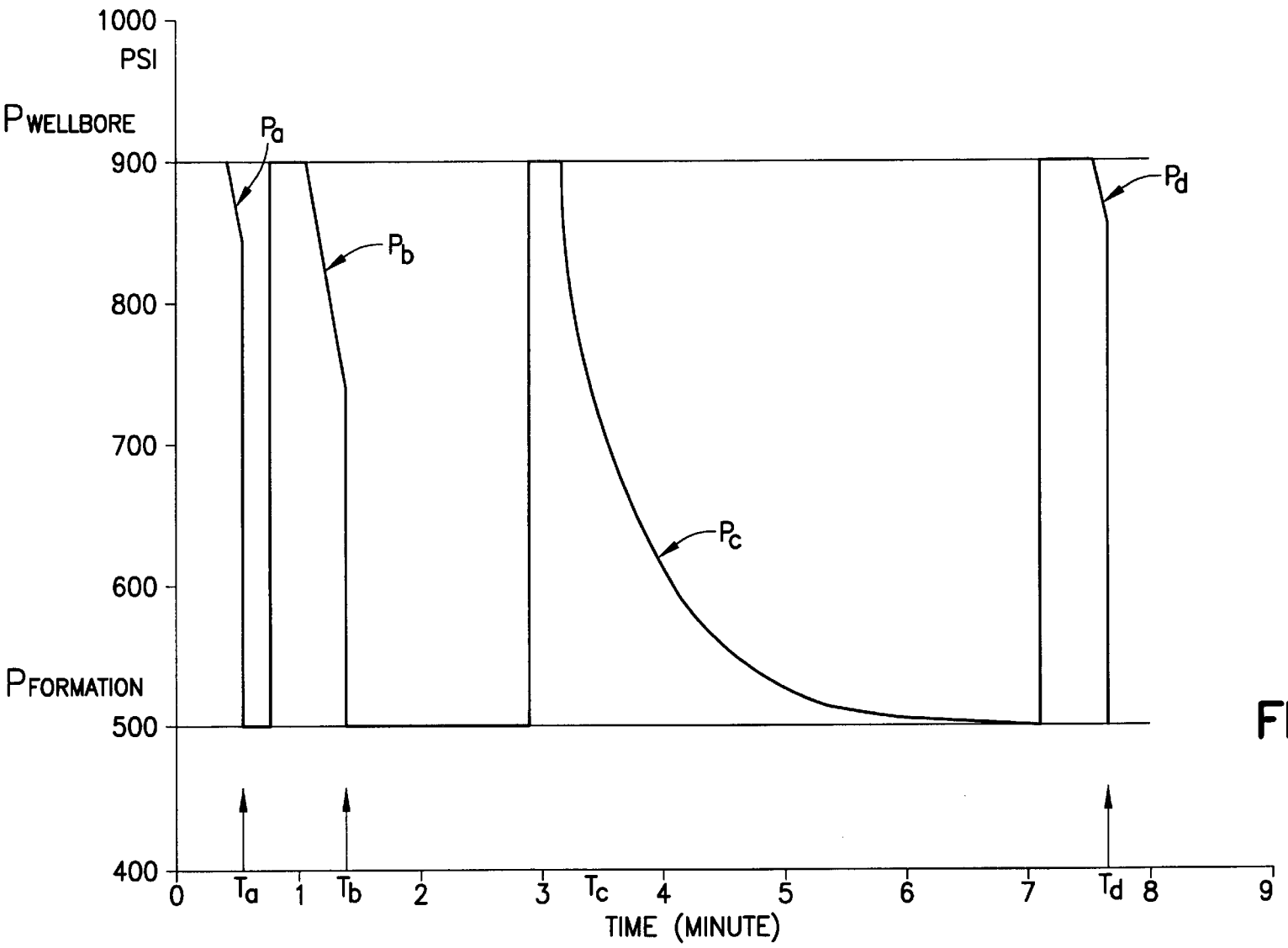

FIGS. 4*a–c* illustrate different pressure drops occurring in isolated portions of the formation when mudcake is undisturbed and when mudcake is fluidized. FIGS. 4*a–c* plot pressure as a function of time. Referring to FIG. 4*a*, in one experiment using a laboratory set-up, a tool having a pressure sensor 24 was moved through a high-pressure fluid against a mock-up of an earth formation having mudcake. The pressure sensor was moved until the chamber isolated a portion of the formation, enclosing high-pressure fluid and mudcake within the filled chamber. A pressure gauge was connected to indicate pressure within the chamber. The fluid and mudcake were left undisturbed. Because of the great pressure difference between the high-pressure fluid and that of the formation, fluid flow eventually occurred through the mudcake membrane, though very slowly. Pressure in the chamber continued to drop over a relatively long time towards equilibrium, approaching that of the formation pressure, as FIG. 4*a* indicates. In one test, initial pressure in the chamber, corresponding to mud column pressure, was about 325 psi. Formation pressure was about 105 psi. After one hour, pressure in the chamber had dropped to 125 psi, still well above that of the formation pressure. This slow pressure drop illustrates the relative impermeability of the mudcake.

Referring to FIG. 4*b*, in another experiment with the laboratory set-up, the tool having a pressure sensor 24 was again moved through the high-pressure fluid against the formation and mudcake. The pressure sensor 24 was moved until the chamber isolated a portion of the formation, enclosing high-pressure fluid and mudcake within the filled chamber. The pressure gauge indicated pressure within the chamber. Initially, the fluid and mudcake were left undisturbed. Fluid flow through the mudcake was negligible. Pressure in the chamber started to drop slowly towards equilibrium, in the manner of FIG. 4*a*. However, at time T, the horn of the pressure sensor 24 produced an acoustic pulse. The acoustic pulse fluidized the mudcake, disintegrating the mudcake membrane. Because the mudcake had been fluidized and because the borehole pressure is substantially above that of the formation, fluid flow occurred between the chamber and the formation. Pressure equilibrium, equal to formation pressure, was reached in microseconds. The pressure gauge generated a signal indicating the pressure of the chamber at equilibrium. The signal from the pressure gauge represented a direct measurement of formation pressure.

FIG. 4*c* illustrates still another experiment with the laboratory set-up. The tool having a pressure sensor 24 was again moved through the high-pressure fluid against the formation and mudcake, enclosing high-pressure fluid and mudcake within the filled chamber. Wellbore pressure was 900 psi and formation pressure was 500 psi. The pressure gauge continuously measured pressure within the chamber as indicated by the curve. Initially, the fluid and mudcake were left undisturbed. There is an initial slow decay to pressure equilibrium, in the manner of FIG. 4*a*, is shown at curve Pa. However, at time Ta the horn of the pressure sensor 24 produced an acoustic pulse.

The acoustic pulse at time Ta fluidized the mudcake. Because the mudcake had been fluidized, pressure in the chamber drops to formation pressure in microseconds, as evident from the curve. Thus, the pressure gauge generates a signal indicating a direct measurement of formation pressure, made while the tool moves and engages the surface of the formation. Similarly, the horn produced an acoustic pulse at times Tb and Td and pressure equilibrium was reached and formation pressure was measured in microseconds, as indicated by the curves Pb, Pd. At time Tc, the horn was silent, and the expected slow decay to pressure equilibrium continued over a period of about 4 minutes as shown by curve Pc.

It is also possible to make formation pressure measurements while moving the tool 10. In still another experiment with the laboratory set-up, measurement-while-moving conditions were simulated. A tool was pressed against and dragged along the surface of the formation while pressure measurements were made. This experiment illustrated that it is not necessary to have a stationary tool to make these pressure measurements. On the contrary, it is possible to make formation pressure measurements while moving a tool through a borehole. Such a moving tool can be part of a drill string, for example.

A mock-up pressure sensor was moved until the chamber isolated a portion of the formation, enclosing only high-pressure fluid containing mud filtrate within the filled chamber. The tool was pressed against and dragged along the surface of the formation at 10 feet per hour at 1000 psi. Due to the large mud particle size distribution of the filtrate compared to the gap between the chamber face and borehole wall, the mud itself seals the chamber to the borehole wall. A gap as large as 0.5 mm can be clogged by the particles as large as 100 microns, which are normally found in drilling muds. The ability of mud to create such a seal is described in U.S. patent application, Ser. No. 08/483,137 to Auzerais, et al., filed Jun. 7, 1995, concerning FIGS. 13*a–f*, for example, which is incorporated herein by reference.

A pressure gauge continuously indicated fluctuating pressure within the chamber. Wellbore pressure was 200 psi. Formation pressure was 150 psi. The mud filtrate was hydraulically flushed from inside the chamber. Flushing the mud filtrate simulated the effects of an acoustic horn for the purposes of this experiment. However, mud filtrate under influence of the higher wellbore pressure continued to seal the outside of the chamber.

As mud filtrate is flushed from inside the chamber, where the chamber abuts the formation, pressure within the chamber quickly drops to that of the formation pressure. As flushing ceases, the mud filtrate accumulates within the chamber, again forming a membrane against the formation. The pressure within the chamber is not affected by the sealed-off wellbore pressure. Pressure within the chamber indicates formation pressure of a moving borehole tool.

Figure 5:
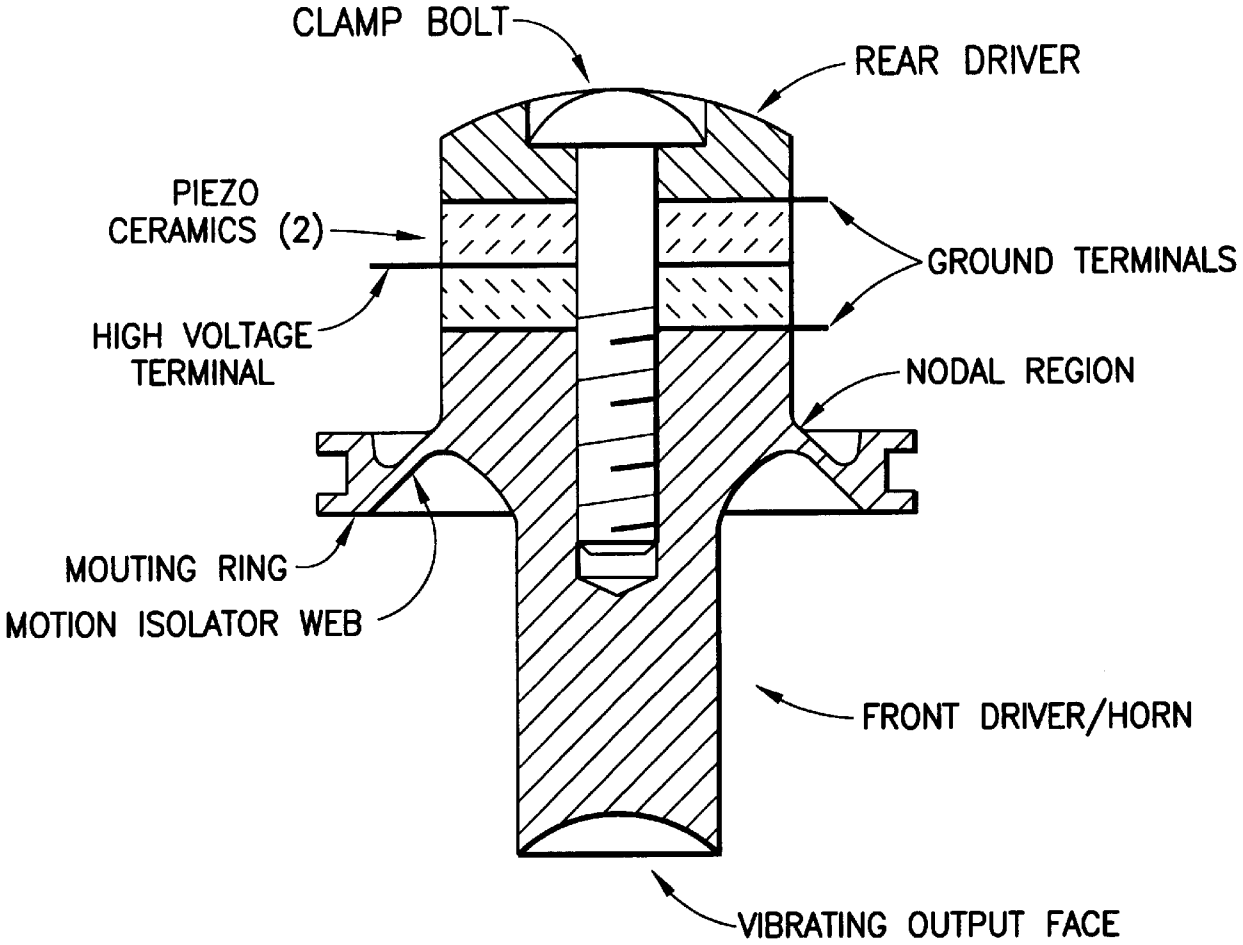
FIG. 5 shows a schematic of an acoustic horn.

FIG. 5 shows a schematic of one example of an acoustic horn. The horn comprises an acoustic transducer on the order of 3 cm in diameter and 5 cm long. The horn is designed to vibrate at 53.5 KHz in the axial direction, for example. The design of the horn includes a node at its base, chosen so the horn directs a very narrow stream of focused acoustic energy along its axis toward the mudcake. It is this narrow stream of focused acoustic energy which vibrates the mudcake into suspension within the fluid contained in the chamber. The mounting ring seals the horn within the chamber. Stainless steel terminals connect via wires to the driving circuitry to receive an oscillating signal from the driving circuitry. Piezoelectric crystals between the electrodes are tuned to vibrate the horn at 53.5 KHz, for example. A concave surface of the vibrating output face can be added to focus the beam of energy emitted by the horn 24.

Modifications to this embodiment are apparent. For example, mechanical devices, such as stirrers or mixers, could be driven by hydraulic or electrical power to agitate the fluid in the chamber until a portion of the mudcake fluidizes. Also, fluid jets drawn from the pressurized mud column could agitate the fluid in the chamber until a portion of the mudcake fluidizes. The cup itself or other member defining the chamber can be vibrated by the driving circuitry. In this case, there is no need for a horn. Details of this embodiment are described further in copending U.S. patent application Ser. No. 08/630,739, incorporated herein by reference. Other horns are described in U.S. Pat. Reissue No. 33,063.

In addition, volume expansion, as occurs in the MDT filter valve, can also remove mudcake from the borehole wall. The chamber could be defined by a cylindrical bore and piston, for example. As the piston is withdrawn, the volume of the chamber would expand. Pressure within the chamber would drop which would remove mudcake from the borehole wall.

Pressure is one parameter of an earth formation which can be measured to evaluate the earth formation. Other parameters, such as density, lithology, resistivity, grain structure or size, porosity, etc., can be measured after the mudcake is fluidized using nuclear, electromagnetic video or geoacoustic borehole tools.

The tool 10 can be either a wireline tool, or a logging-while-drilling tool. A wireline version of the tool 10 can be lowered into the borehole 14 on a cable and is winched to the surface while data representing characteristics of the formation as a function of depth are logged. A housing 16 of a wireline tool 10 encloses necessary electronics to isolate them from borehole fluids the tool housing A retractable arm could extend from the housing, forcing the tool against the formation so that the recessed chamber in the exterior surface of the housing, opposite the retractable arm, isolates a portion of the formation. In the case of underbalanced conditions, where there is no mud column, for instance, pressure can than be measured directly, without operating the acoustic horn.

I claim:

1. A method for evaluating a characteristic of a formation comprising:

placing a tool in a borehole in a formation;

isolating a portion of the formation by placing a chamber of the tool against a wall of the borehole;

producing vibrations within the chamber and loosening material from the borehole wall within the chamber while maintaining isolation of said portion of the formation by the chamber of the tool;

measuring pressure within the chamber and producing a corresponding first signal; and using the first signal in evaluating a characteristic of the formation.

2. The method of claim 1, comprising:

producing a first signal representing pressure within the chamber while producing vibrations within the chamber.

3. The method of claim 2, comprising:

producing motion within the chamber by vibrating fluids within the chamber.

4. The method of claim 3, comprising:

vibrating the fluids with an acoustic transducer.

5. The method of claim 1, comprising:

producing motion within the chamber by vibrating fluids within the chamber.

6. Method of indicating an earth formation characteristic, the steps comprising:

isolating a portion of a borehole wall of a formation with a borehole tool, the isolated portion containing fluid and material;

using the borehole tool, and while maintaining isolation of said portion of the borehole wall with the borehole tool, moving the material into fluid suspension;

producing a signal with the borehole tool representing a parameter of the formation adjacent the isolated portion of the borehole wall; and indicating an earth formation characteristic based on the produced signal.

7. The method of claim 6, comprising:

vibrating the material into fluid suspension with an acoustic transducer.

8. The method of claim 7, comprising:

isolating the portion of the borehole wall with a recess of the tool which defines a chamber.

9. The method of claim 7, the material comprising mudcake, the steps comprising:

generating a pulse with the acoustic transducer sufficient to fluidize the mudcake.

10. The method of claim 9, comprising:

generating a narrow stream of acoustic energy against the mudcake.

11. Method of indicating an earth formation characteristic, the steps comprising:

defining a volume by isolating a portion of a borehole wall of a formation with a borehole tool, fluid and mudcake being adjacent the borehole wall within the volume;

fluidizing the mudcake within the volume while maintaining ioslation of said portion of the borehole wall with the borehole tool;

detecting pressure of the volume and producing a signal with the borehole tool related to pressure of the formation adjacent the isolated portion of the borehole wall as pressure of the formation and on the volume reach equilibrium; and indicating an earth formation characteristic based on the produced signal.

12. The method of claim 11, comprising:

urging the borehole tool against the formation; and isolating the portion of the borehole wall with a recess in the borehole tool.

13. The method of claim 12, comprising:

moving the fluid in a manner which puts mudcake of the isolated portion into fluid suspension.

14. The method of claim 13, comprising:

using an acoustic transducer to vibrate the fluid and fluidize the mudcake.

15. The method of claim 11, comprising:

moving the fluid in a manner which puts mudcake of the isolated portion into fluid suspension.

16. Apparatus for evaluating an earth formation characteristic, comprising:

a body for passage within a borehole in a formation, the borehole containing fluid and having a wall;

the body having a chamber for isolating some of the fluid and a portion of the borehole wall;

an element associated with the chamber for moving material within the chamber into suspension with the fluid while said chamber maintains isolation of said some of the fluid and a portion of the borehole wall; and a pressure sensor for producing a signal related to pressure with the chamber, the signal indicating an evaluation of a characteristic of the formation.

17. The apparatus of claim 16, a recess in the body which comprises the chamber.

18. The apparatus of claim 17, the element comprising an acoustic transducer for directing acoustic energy through the fluid toward the mudcake.

19. The apparatus of claim 18, the acoustic transducer having a generally elongated horn extending into the chamber for substantially producing an axial pulse with respect to the elongated horn.

20. The apparatus of claim 19, the body comprising:

a portion of a borehole tool for gathering data about the formation from within the borehole.

* * * * *